United States Patent [19]

Knowles

[11] 4,183,311

[45] Jan. 15, 1980

[54] SNAP-ON PRESSER FOOT PLATE

[75] Inventor: Warren D. Knowles, Clark, N.J.

[73] Assignee: The Singer Company, New York, N.Y.

[21] Appl. No.: 20,672

[22] Filed: Mar. 15, 1979

[51] Int. Cl.[2] ..... D05B 29/06

[52] U.S. Cl. ..... 112/235

[58] Field of Search ..... 112/235, 240, 60

[56] References Cited

U.S. PATENT DOCUMENTS

| | | | |
|---|---|---|---|
| 2,288,404 | 6/1942 | Kahre | 112/235 |
| 2,317,185 | 4/1943 | Dunlap | 112/261 |
| 3,044,428 | 7/1962 | Hale et al. | 112/235 |
| 3,334,605 | 8/1967 | Boser | 112/235 |
| 3,495,560 | 2/1970 | Walling | 112/235 |

FOREIGN PATENT DOCUMENTS

| | | | |
|---|---|---|---|
| 1073840 | 3/1957 | Fed. Rep. of Germany | 112/235 |

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A sewing machine presser device is provided with a sole plate and with a latching spring which can be snapped into a retaining notch at the front edge of a shank on the device to hold a hinge pin on the foot up in a recess at the bottom of the shank and which can be readily dislodged from said notch to enable easy removal of the sole plate from the machine.

7 Claims, 4 Drawing Figures

SNAP-ON PRESSER FOOT PLATE

BACKGROUND OF THE INVENTION

1. Field of the Invention

The invention relates to sewing machine presser devices. More particularly the invention is directed to a presser device permitting the quick and easy exchange of sole plates.

2. Description of the Prior Art

The prior art includes many presser devices intended to provide for quick exchangeability of presser foot sole plates on sewing machines. However, the prior art devices have generally been deficient either because they were so constructed as to require an excessive number of parts and were costly to produce; or because the sole plates were not easily removed or replaced, and when in place on a presser bar assumed a position with the presser bar of the machine released such as to interfere with the insertion of work by an operator under the sole plate.

It is a prime object of this invention to provide a presser device requiring only a few simple parts, permitting a sole plate to be easily removed or attached to a shank with the flip of an operator's finger, and preferably causing the sole plate to be held at an angle, when the presser bar is released, such that an operator may easily insert material to be sewn under the sole plate.

SUMMARY OF THE INVENTION

A presser device is provided, in accordance with the invention, with a shank and a sole plate, and with a latching spring which pivotally connects with the sole plate. The shank includes a blade with a spring retaining notch on its front edge and the latching spring snaps into such retaining notch to hold a hinge pin on the sole plate up in a recess at the bottom of the shank. Preferably the latching spring pivotally connects with the sole plate just forward of the hinge pin and holds the toe of the sole plate up at an angle relative to work when a presser bar, to which the presser device is attached, is released. The latching spring is easily dislodged from the retaining notch with the application of pressure at a strategic location on the spring whereupon the sole plate and spring can be removed from the shank of the device.

Figure 1:
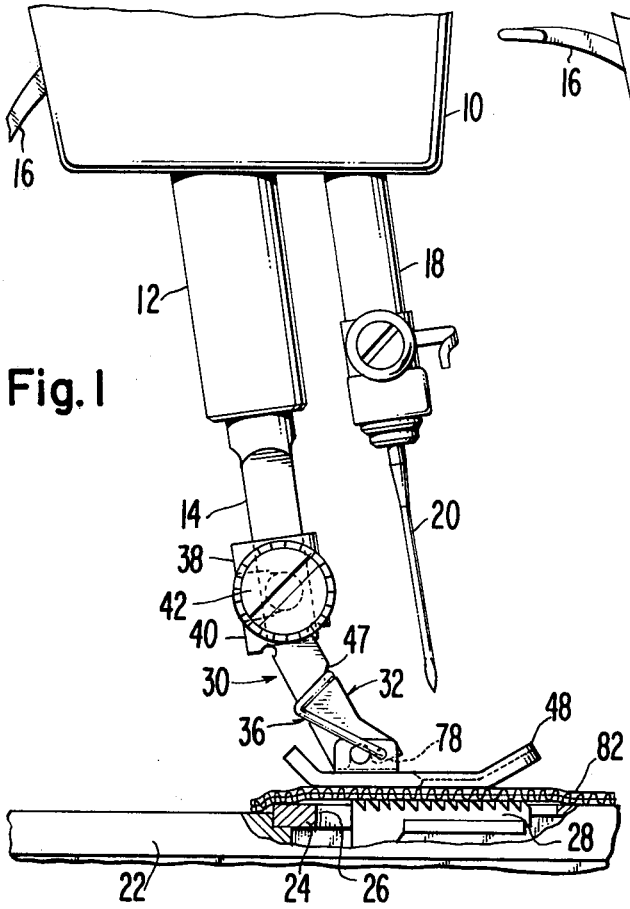
FIG. 1 is a side elevational view of a fragment of a sewing machine showing the presser device of the invention on a lowered presser bar.

Referring to the drawings, reference character 10 designates the bracket arm of a sewing machine frame. A bushing 12 is secured in the bracket arm and a presser bar 14 is slidable endwise in the bushing. The presser bar, as is conventional, is provided with a spring (not shown) to bias it downwardly, however, the presser bar may be raised and lowered at will by a presser lifting lever 16 carried in the bracket arm. A needle bar 18 carrying a needle 20 for the formation of stitches is endwise reciprocable in the bracket arm. The sewing machine frame includes a work supporting bed 22 beneath the bracket arm. The bed carries a throat plate 24 that is formed with slots 26 through which a feed dog 28 of a conventional sewing machine feed mechanism is operative. Carried on the presser bar above the feed dog is the presser device 30 of the invention. Such presser device 30 includes a shank, a sole plate, and a latching spring, each of which have been generally indicated by a reference character, namely the reference characters 32, 34 and 36 respectively.

The presser foot shank 32 which is preferably fabricated of a sheet metal stamping is formed at the top with a U-shaped presser bar accommodating seat defined at one side by an outturned tab 37 and at the other side by outturned bifurcations 38 and 40. The presser foot shank is secured to the presser bar by means of a shouldered clamp screw 42 which passes between the bifurcations and is threaded into the presser bar 14. Depending from the presser bar accommodating seat is a blade 44 in the bottom of which there is formed a recess 46 and in one edge of which there is provided at notch 47.

The sole plate 34 is formed between toe end portions 48 and heel end portion 50 with upstanding ears 52 and 54 spaced apart a distance substantially equal to the thickness of blade 40 on the presser foot shank. Covered by the ears 52 and 54, and extending transversely therebetween is a cylindrical pivot 55. The ears 52 and 54 are provided with drilled holes 56 and 58 respectively extending parallel to pivot 52.

Latching spring 36 is a preformed resilient wire spring having spaced apart transversely extending fingers 60 and 62 at one end, and including a cross-piece 64 at the other end which is parallel to the fingers 60 62. The crosspiece 64 of the spring connects with bent arm portions 66 and 68 that include elbows 70 and 72 respectively.

The latching spring and sole plate are normally maintained in an assembled relationship by the spring fingers 60 and 62 which extend into the drilled holes 56 and 58 in the ears 52 and 54 of the sole plate and thereby pivotally connect the sole plate to the spring. The sole plate and spring are readily attached to the shank 32 by positioning pivot 55 on the sole plate in notch 46 of the blade 44 and pushing crosspiece 64 on the spring upwardly on the edge 74 of the blade 44 until the crosspiece snaps into notch 47. The sole plate and spring are readily removed from the shank 32 by pushing on the elbows 70 and 72 of the spring with the finger (see FIG. 2).

Figure 2:
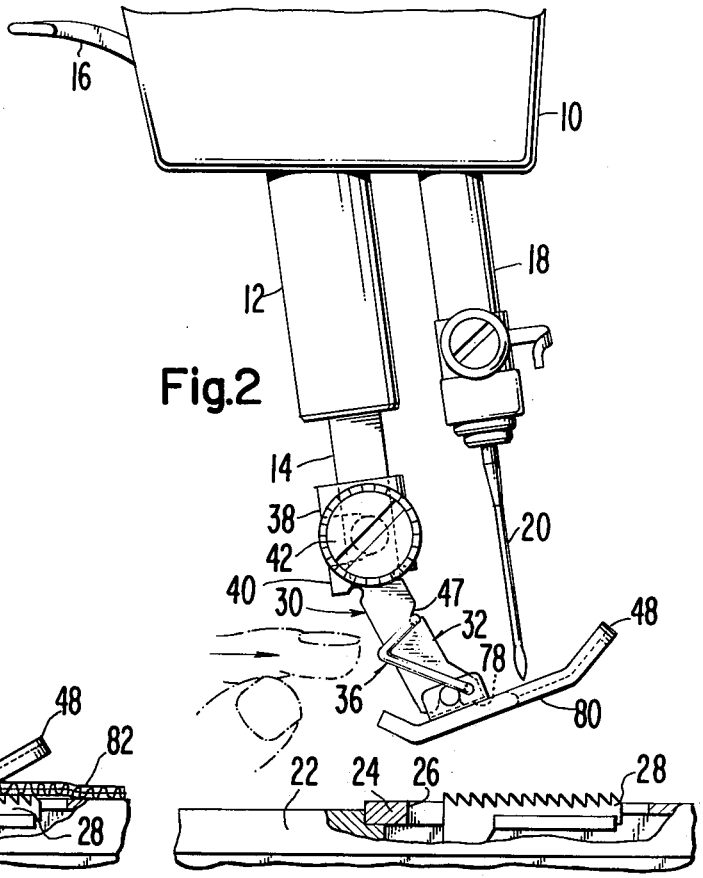
FIG. 2 is a view similar to FIG. 1 but with the presser bar in a released position.
Figure 3:
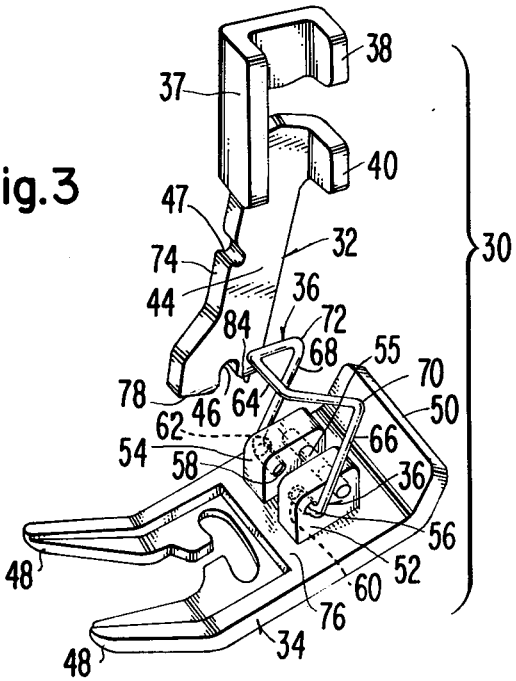
FIG. 3 is an enlarged perspective view of the presser device of the invention.
Figure 4:
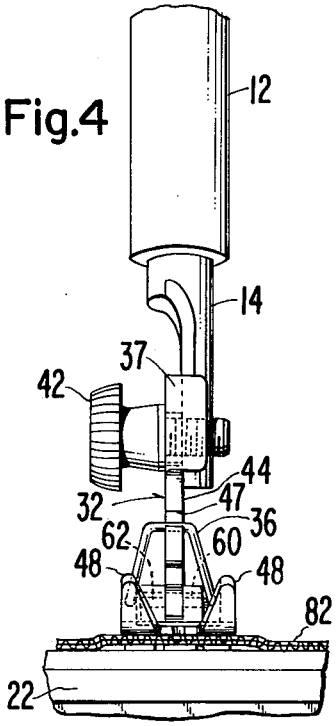
FIG. 4 is a front elevation view of the sewing machine fragment of FIG. 1 including the presser device of the invention.

With the sole plate and spring attached to shank 32 and the presser bar in a released position as shown in FIG. 2 the sole plate is caused by spring 36 to assume a pivoted position with the toe end up and heel end down as defined by the engagement of surface 76 on the throat plate with a bottom edge 78 on blade 44. It is an advantage to have the sole plate raised at the toe end rather than depressed when the presser bar is released because an operator can easily insert work to be sewn under the sole plate when it is so raised. When the presser bar 14 is depressed with handle 16 at the time sewing is to be initiated, the sole plate pivots downwardly from its toe up position as it comes in contact with the work, and the work engagable surface 80 thereon is caused to lie flat against the fabric 82 under it (see FIG. 1). In the fabric engaging position of the sole plate, bottom edge 84 on blade 44 is engaged by surface 76 on the sole plate.

It is to be understood that the present disclosure relates to a preferred embodiment of the invention which is for purposes of illustration only, and that various modifications may be made therein without departing from the spirit and scope of the invention as defined in the appended claims.

I claim:

1. A presser device for a sewing machine having a presser bar thereon, said presser device including a shank which detachably connects with the presser bar and has a recess at the bottom end, a latching spring, and a sole plate connected to one end of the latching spring, the sole plate having a hinge pin thereon, said shank including a notch in one edge wherein the other end of the spring is disposed to stretch the spring and cause the spring to hold the hinge pin on the sole plate up in the recess at the bottom end of the shank.

2. A presser device as defined in claim 1 wherein the spring between the ends thereof extends beyond an edge of the shank opposite the edge which includes said notch.

3. A presser device as defined in claim 1 wherein the spring is a performed length of resilient wire.

4. A presser device as defined in claim 1 wherein the sole plate is pivotally connected to the latching spring.

5. A presser device as defined in claim 4 wherein the sole plate includes a toe end and a heel end, and the latching spring pivotally connects with the sole plate at a location between the hinge pin and toe end of the sole plate to bias the sole plate about the hinge pin in a direction such as to raise the toe end of the sole plate.

6. A presser device as defined in claim 5 including a surface on said shank engageable with the sole plate for defining the raised position of the toe end of the sole plate.

7. A presser device as defined in claim 6 wherein said surface is on the bottom of the shank.

* * * * *